United States Patent [19]

Valiant

[11] Patent Number: 4,831,949

[45] Date of Patent: May 23, 1989

[54] SPINNAKER LAUNCHING AND DOUSING DEVICE

[76] Inventor: Dimitri Valiant, 1729 Bayview Ave., Erie, Pa. 16505

[21] Appl. No.: 72,772

[22] Filed: Jul. 13, 1987

[51] Int. Cl.[4] ..... B63H 9/10

[52] U.S. Cl. ..... 114/104

[58] Field of Search ..... 114/104, 105, 102, 103; 160/344

[56] References Cited

U.S. PATENT DOCUMENTS

| | | | |
|---|---|---|---|
| 23,440 | 4/1859 | Benson | 114/104 |
| 211,712 | 1/1879 | Dickenson | 114/105 |
| 2,544,770 | 3/1951 | Willis | 114/103 |

*Primary Examiner*—Sherman D. Basinger

*Attorney, Agent, or Firm*—Ralph Hammar

[57] ABSTRACT

A spinnaker sail is furled by bunching the edges of the sail together edgewise and holding the edges in a compact bunch by a furling line. The spinnaker is unfurled by hoisting the spinnaker to the top of the mast, releasing the furling line, and pulling the lower corners of the spinnaker downward. The furling line extends through circumferentially spaced guides extending around the periphery of the sail. In a preferred form, one end of the furling line is fastened to a first guide at the bottom of the sail and extends from the first guide sequentially through the other guides spaced around the periphery of the sail and back through said first guide to receive a tension force areally compressing the sail edgewise into a compact bunch which is held in place by the furling line.

13 Claims, 5 Drawing Sheets

SPINNAKER LAUNCHING AND DOUSING DEVICE

Spinnakers are generally triangular sails used on the side of the boat opposite the main sail when the boat is sailing before the wind.

U.S. Pat. No. Re. 29,279, U.S. Pat. No. 4,262,617, U.S. Pat. No. 3,828,712, U.S. Pat. No. 3,750,608 and U.S. Pat. No. 3,310,018 show prior expedients for handling spinnakers.

One of the problems of the spinnaker-type sails is that they can become dangerously uncontrollable if the sail fills before it can be fully hoisted and the halyard supporting the sail cleated. The spinnaker can also be difficult to control when taking the sail down in any breeze, as the crew must deal with a flogging sail which is attached only at the three corners.

In accordance with this invention, a sailor can set and take down spinnakers in such a way that the sail is fully hoisted before being deployed and is fully furled before being taken down. Additionally, the sail after dropping is ready to be used without repacking, which is required with a conventional spinnaker.

Figure 2:
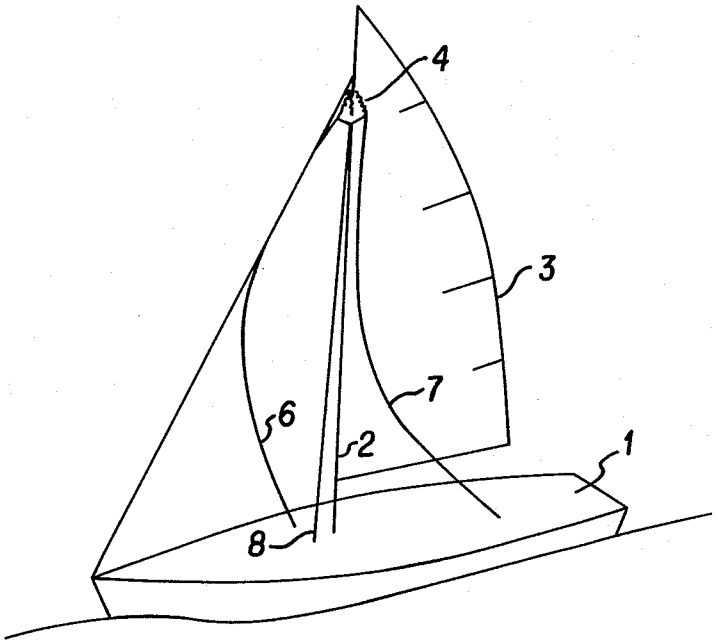
FIG. 2 shows the boat with the furled spinnaker raised to the top of the mast.
Figure 1:
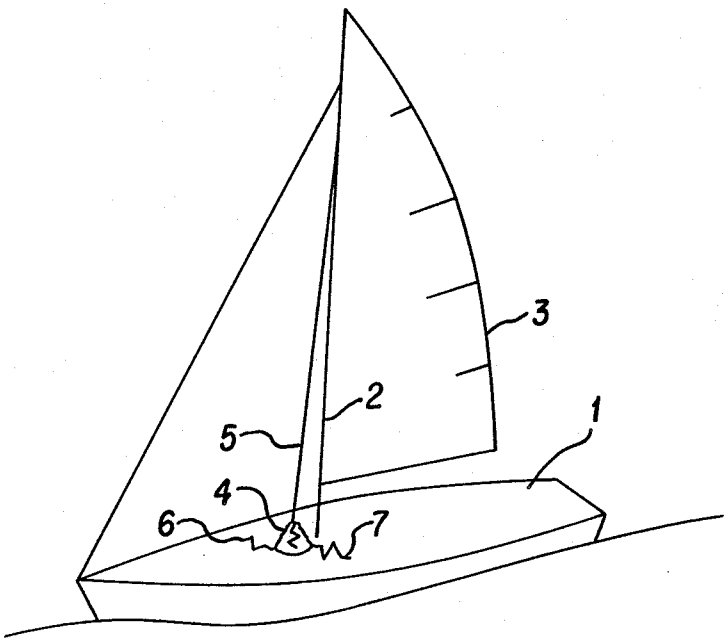
FIG. 1 shows a boat with a furled spinnaker.

In the drawing, 1 indicates a boat with a mast 2, a main sail 3, a furled spinnaker 4, a spinnaker halyard 5 attached to the upper end of the spinnaker, and 6,7 guy and sheet lines attached to the lower corners of the spinnaker. There is also a furling line 8 which holds the spinnaker 4 in its furled condition.

Figure 4:
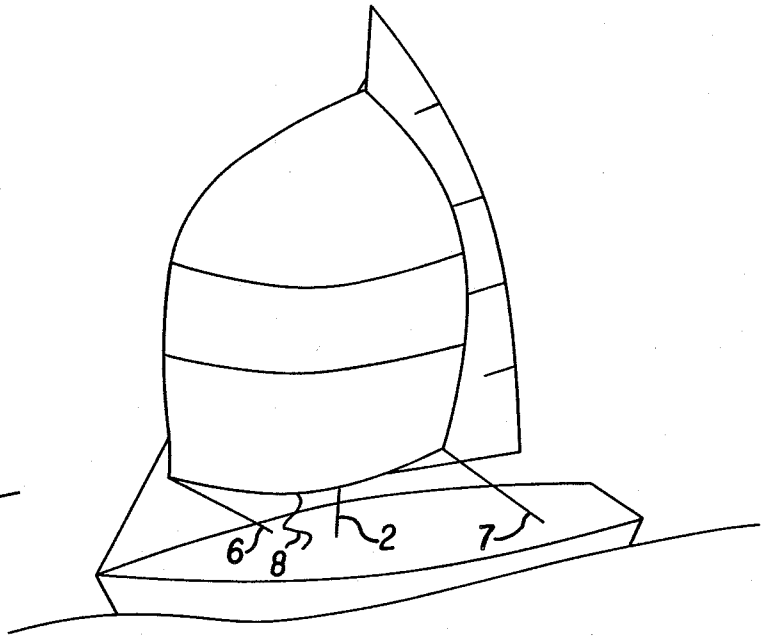
FIG. 4 shows the same spinnaker completely unfurled.
Figure 3:
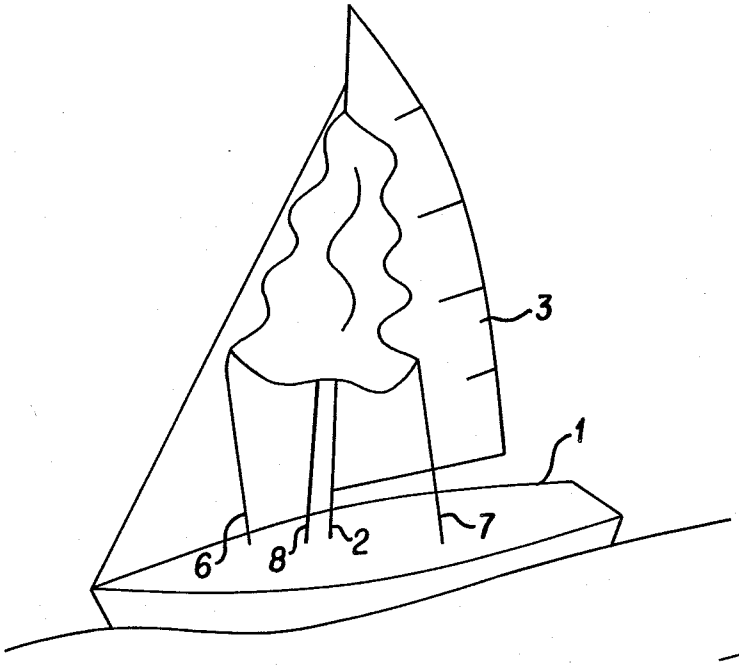
FIG. 3 shows the unfurling of the spinnaker at an intermediate stage.
Figure 6:
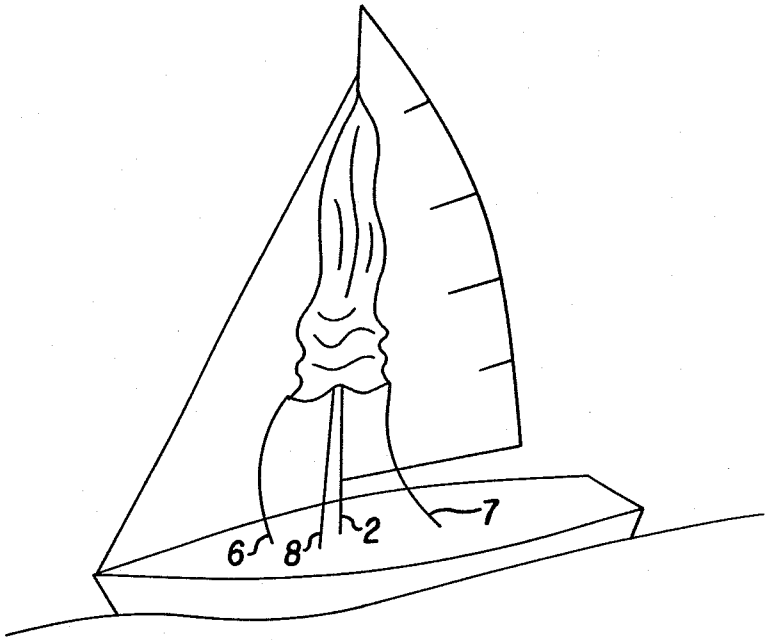
FIG. 6 shows the furling of the spinnaker at an intermediate stage.
Figure 5:
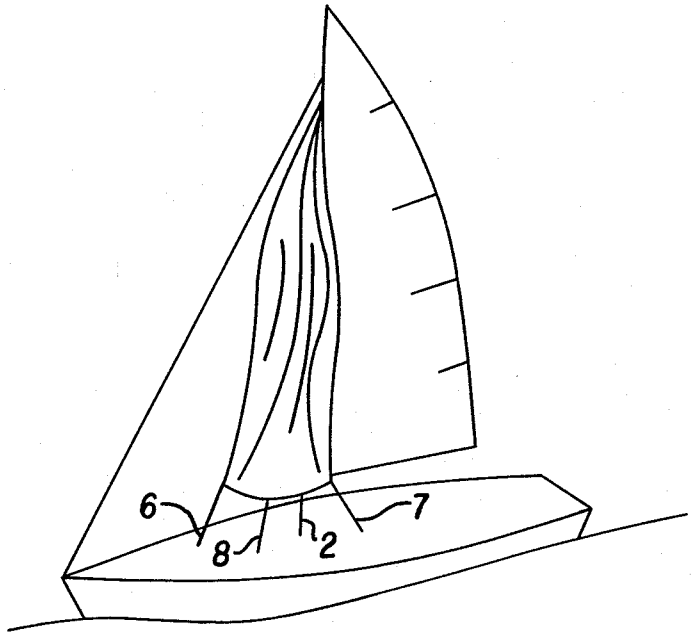
FIG. 5 shows the start of the furling of the spinnaker.

At the start of the unfurling, the furled spinnaker is raised to the top of the mast and the upper end of the spinnaker is anchored in place by the halyard 5. Relaxing the tension of the furling line 8 and pulling on the guy and sheet lines 6, 7 lowers the lower corners of the spinnaker. The relaxing of the tension of the furling line 8 allows the wind to blow the lower end of the sail outward. The force of the wind on the parts of the sail which have been unfurled acts in the direction to further unfurl the sail so that when the sail has been completely lowered as shown in FIG. 4 it is filled with air and the force of the wind is being transmitted to the boat through the halyard 5 and the lines 6, 7.

Figure 8:
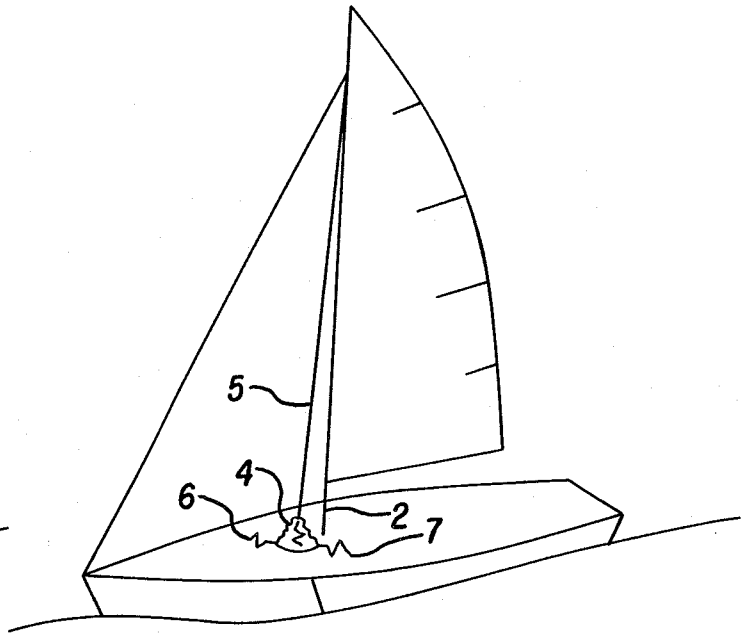
FIG. 8 shows the completely furled spinnaker lowered to the deck.
Figure 7:
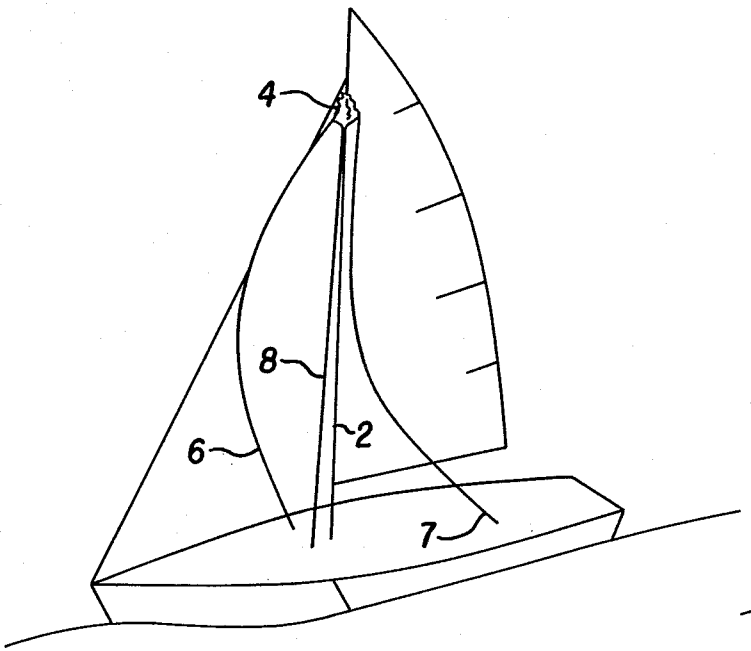
FIG. 7 shows the completely furled spinnaker at the top of the mast.

When the boat is no longer running before the wind, the spinnaker should be furled. This is accomplished by pulling on the furling line 8 which pulls the sides of the sail toward each other by the structure shown in FIG. 9 and reduces the windforce on the spinnaker so that the spinnaker can be raised furled by further tensioning the furling line 8. The guy and sheet lines 6, 7 have to be relaxed to permit the upward movement of the lower corners of the sail necessary for furling. When the sail is completely furled as shown in FIG. 7, the spinnaker is at the top of the mast 1 in readiness to be lowered to the storage position of FIG. 8 by tensioning the lines 6, 7 and releasing tension in the furling line 8.

Figure 9:
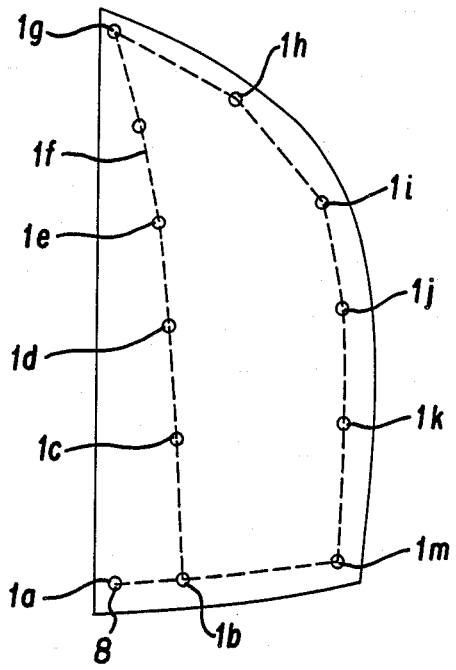
FIG. 9 shows one form of furling line for the spinnaker.

FIG. 9 shows one-half of a spinnaker with a row of guide rings 1*b*, 1*c*, 1*d*, 1*e*, 1*f* and 1*g* attached to the sail along the center edge, a row of guide rings 1*g*, 1*h*, 1*i*, 1*j*, 1*k*, 1*m* attached to the sail along the outer edge and a row of guide rings 1*a*, 1*b*, 1*m* arranged along the bottom edge of the sail. One end of the furling line 8 is tied to ring 1b and then runs sequentially through rings 1*c*, 1*d*, 1*e*, 1*f*, 1*g*, 1*h*, 1*i*, 1*j*, 1*k*, 1*m*, 1*b*, 1*a* and out to a free end. Upon tensioning the free end of the furling line 8 the sail in the row 1*g* through 1*m* will be collapsed toward the sail in the row 1*g* through 1*b* and at the same time the sail along the bottom edge 1*a*, 1*b*, 1*m* will be moved upward toward the top of the sail 1*g*. This action takes place by the tensioning of the furling line 8. As the guide rings are moved toward each other as described the edges of the sail move together and effectively collapse the sail and place the sail in a furled condition. As the furling line is pulled further, the collapsed sail begins to be gathered in a vertical fashion, until the entire sail has been bunched up at the mast head. The furled and packed sail is then lowered to the deck. The furling line 8 acts as a noose with its slip joint at ring 1b. For the specific structure shown where FIG. 9 represents one-half of a sail, the furling line 8 would be two lines, each of which acted in unison and which caused the collapse of both halves of the sail simultaneously from side-to-side and bottom-to-top as the furling line was tensioned.

I claim:

1. A spinnaker having guides circumferentially spaced from each other around the periphery of a section of the spinnaker and a furling line extending through said guides for collapsing said section edgewise both laterally and vertically as said line is tightened to furl said section, one end of the furling line being fixed to the lower end of the spinnaker and the other end after extending through said guides being accessible for tightening the line to furl said spinnaker.

2. The structure of claim 1 in which the spinnaker has at least two of said sections.

3. The structure of claim 2 in which each section is collapsed by a separate furling line and the furling lines are jointly tightened.

4. The method of furling the spinnaker of claim 1 which comprises the steps of collapsing the spinnaker edgewise from the sides of the sail toward the center of the sail and from the bottom of the sail toward the top of the sail by a noose slidably extending through said guides and tightened by said furling line.

5. The method of unfurling a spinnaker furled by the method of claim 4 which comprises the steps of raising the furled spinnaker and securing the upper end of the furled spinnaker to the top of a mast, releasing the furling line and pulling the lower ends of the spinnaker downward to catch the wind and aid in the unfurling.

6. The structure of claim 1 in which the guides are rings on the wind receiving surface of the sail.

7. The structure of claim 1 in which said furling line has one end attached to a first guide on the lower end of said section and extends from said first guide sequentially through said other guides around the periphery of said section and back through said first guide for receiving forces for pulling said line through said guides to collapse or furl said section of the sail.

8. The method of furling the spinnaker of claim 1 which comprises fixing the top of the spinnaker to a mast and moving the bottom of the spinnaker toward the top while moving the sides of the spinnaker toward each other so the furled spinnaker is compressed from side-to side and from bottom to top.

9. In combination with a generally triangular spinnaker on the side of a boat opposite the main sail when the boat is sailing before the wind, a halyard fixed to the upper corner of the sail for transmitting wind forces from the sail to the mast of the boat, guy and sheet lines fixed to the lower corners of the sail for transmitting wind forces from the sail to the boat and means for furling the sail by a furling line gathering the edges of the sail edgewise from side-to-side and from bottom to top in a bunch at said halyard.

10. The method of furling the spinnaker of claim 9 which comprises gathering the peripheral edges of the spinnaker into a compact bunch and holding the bunch together by a releasable furling line encircling said bunch.

11. The method of unfurling the spinnaker of claim 9 which comprises hoisting the furled spinnaker to the top of a mast by said halyard and fixing the halyard to the top of the mast and pulling downward on the guy and sheet lines to unfurl the spinnaker and attaching the guy and sheet lines to the boat when the spinnaker is unfurled.

12. The method of unfurling a spinnaker of claim 9 which comprises hoisting the furled spinnaker to the top of a mast by said halyard, fixing the halyard to the top of the mast and releasing the furling line and pulling downard on said guy and sheet lines.

13. The method of unfurling the spinnaker of claim 9 which comprises hoisting the furled spinnaker to the top of a mast by the halyard fixed to the top of the sail, fixing the halyard to the top of the mast, and relaxing tension of said furling line to permit lowering of the sail by tugging on the guy and sheet lines or by wind force or by both.

* * * * *